US005465508A

United States Patent [19]

Bourdeau

[11] Patent Number: 5,465,508

[45] Date of Patent: Nov. 14, 1995

[54] INSOLE FOR SPORT SHOE

[75] Inventor: Joël Bourdeau, Saint Jorioz, France

[73] Assignee: Salomon S.A., Annecy, France

[21] Appl. No.: 253,593

[22] Filed: Jun. 3, 1994

Related U.S. Application Data

[63] Continuation of Ser. No. 833,523, Feb. 11, 1992, abandoned.

[30] Foreign Application Priority Data

Feb. 11, 1991 [FR] France ..... 91 01785

[51] Int. Cl.[6] ..... A43B 13/38

[52] U.S. Cl. ..... 36/44; 36/3 B

[58] Field of Search ..... 36/43, 44, 3 B, 36/3 R

[56] References Cited

U.S. PATENT DOCUMENTS

| | | | |
|---|---|---|---|
| 1,412,603 | 4/1922 | Berry | 36/44 |
| 4,062,131 | 12/1977 | Hsiung | 36/44 |
| 4,186,499 | 2/1980 | Massok, Jr. et al. | 36/44 |
| 4,192,086 | 3/1980 | Sichak | 36/3 B X |
| 4,461,099 | 7/1984 | Bailly | 36/44 |
| 4,642,912 | 2/1987 | Wildman et al. | 36/3 B X |
| 4,756,314 | 7/1988 | Eckenhoff et al. | 36/182 X |
| 4,774,954 | 10/1988 | Ibrahim | 36/44 X |
| 4,925,724 | 5/1990 | Ogden | 36/44 X |
| 4,990,338 | 2/1991 | Blank et al. . | |
| 5,022,168 | 6/1991 | Jeppson, III et al. | 36/43 |
| 5,044,096 | 9/1991 | Polegato | 36/3 B X |

FOREIGN PATENT DOCUMENTS

| | | |
|---|---|---|
| 0204029 | 6/1988 | European Pat. Off. . |
| 982290 | 6/1951 | France . |
| 1282616 | 12/1961 | France . |
| 1550233 | 12/1968 | France . |
| 2629692 | 10/1989 | France . |
| 3516653 | 11/1986 | Germany . |
| 0362387 | 3/1938 | Italy . |

OTHER PUBLICATIONS

Derwent Abstract for FR2629692.

*Primary Examiner*—Paul T. Sewell
*Assistant Examiner*—Ted Kavanaugh
*Attorney, Agent, or Firm*—Pollock, Vande Sande & Priddy

[57] ABSTRACT

Cleanliness insole for shoes comprising a first layer (10) positioned facing the foot and formed to promote the passage of perspiration from its upper to its lower surface, and a second rigid layer (20) whose upper surface is in contact with the lower surface of the first layer, the second layer delimiting cavities (23) which open onto the upper surface of the second layer. These cavities form a moisture-storage volume and are filled with an absorbent material (30). The moisture is thus stored by the absorbent material, thereby avoiding its transfer to the rest of the shoe and preventing the moisture from rising under the effect of foot pressure.

12 Claims, 1 Drawing Sheet

INSOLE FOR SPORT SHOE

This application is a continuation of application Ser. No. 07/833,523 filed Feb. 11, 1992, now abandoned.

FIELD OF THE INVENTION

The present invention concerns an insole for shoes, in particular for sport or recreational shoes, designed to remedy problems caused by perspiration in the shoe.

BACKGROUND OF THE INVENTION

Current conventional practice provides for the use of movable comfort and cleanliness insoles comprising a combination of an upper wear layer designed to allow perspiration to travel through it, an intermediate layer designed to absorb the perspiration, and a final impermeable layer.

In an insole of this kind, perspiration accumulates in the second layer, but cannot be drained away by the lower, impermeable surface. This insole thus takes a long time to dry, since drying can take place only when the moisture flows in the reverse direction through the first layer.

Furthermore, this type of sole construction risks causing a reverse flow of the water from the intermediate layer to the upper layer during walking, by virtue of the pressures thus generated on this layer.

Patent No. FR 2,629,692 proposes an insole comprising a flexible, absorbent elastic perspiration layer combined, on its lower surface, with a stiffening grid.

The stiffening grid delimits cavities which permit a certain degree of ventilation and evaporation of the moisture through the grid, and constitutes a framework for the insole. However, the ventilation thus created is more or less effective and cannot always be implemented, in particular when the shoe is impermeable and fits tightly. Furthermore, this type of insole does not prevent a transfer of moisture to the rest of the shoe, and this moisture, which remains even when the insole is removed, is difficult to wick away.

Nor does this insole solve the problems associated with the rise of moisture toward the foot under the effect of pressure exerted on the insole during walking or other activity, since the absorbent layer where the moisture is stored remains subjected to the pressure generated by the foot.

SUMMARY OF THE INVENTION

The present invention is intended to overcome these disadvantages and to supply an insole making it possible to absorb the perspiration formed during the practice of a sport or during walking, without risk of the rise of moisture toward the foot or toward the rest of the shoe, when pressure is exerted on the insole.

Another object of the invention is to supply an insole which can be dried rapidly.

These objects are achieved by the insole according to the invention, which is of the type comprising:

- a first layer designed to be positioned on the side facing the foot and manufactured so as to promote the passage of the perspiration from its upper surface to its lower surface, and
- a second, rigid layer whose upper surface is in contact with the lower surface of the first layer, this second layer delimiting cavities which open into the upper surface of this second layer, because the cavities form a volume for storage of moisture and because an absorbent material is arranged on the inside of these cavities.

In fact, the use of the cavities having a fixed volume and delimited by the second, rigid layer for storage of moisture by means of an absorbent material, makes it possible to prevent a transfer of moisture to the rest of the shoe and to avoid the upward flow of moisture, by virtue of the fact that these cavities are subjected to almost no pressure generated by the foot, and that, in any case, the absorbent material does not "desorb" under pressure.

According to another advantageous embodiment, the cavities are formed by holes which open out and extend through the second layer, from its upper surface to its lower surface. In this way, the insole is easily dried after use, since the moisture stored can be drained away directly at the lower ends of the holes without being forced to pass through the first layer again.

Advantageously again, the absorbent material is formed from superabsorbent salts. Accordingly, a substantial osmotic imbalance between the upper and lower surface of the first layer is created, and this imbalance increases the rate and the quantity of water transferred from the upper surface to the lower surface of this first layer.

According to a preferred embodiment, the absorbent material is held in place inside the cavities using a membrane or similar means, which may, moreover, comprise means for the longitudinal transfer of moisture, so as to allow the transfer of moisture of one area of absorbent material to another, and thus, to allow absorption of the moisture even when there is localized saturation of the area.

BRIEF DESCRIPTION OF THE DRAWINGS

The invention will be better understood, and other inventive features will be revealed, from the following description provided with reference to the attached drawings, which represent several embodiments by way of example, and in which.

DESCRIPTION OF THE PREFERRED EMBODIMENTS

Figure 1:
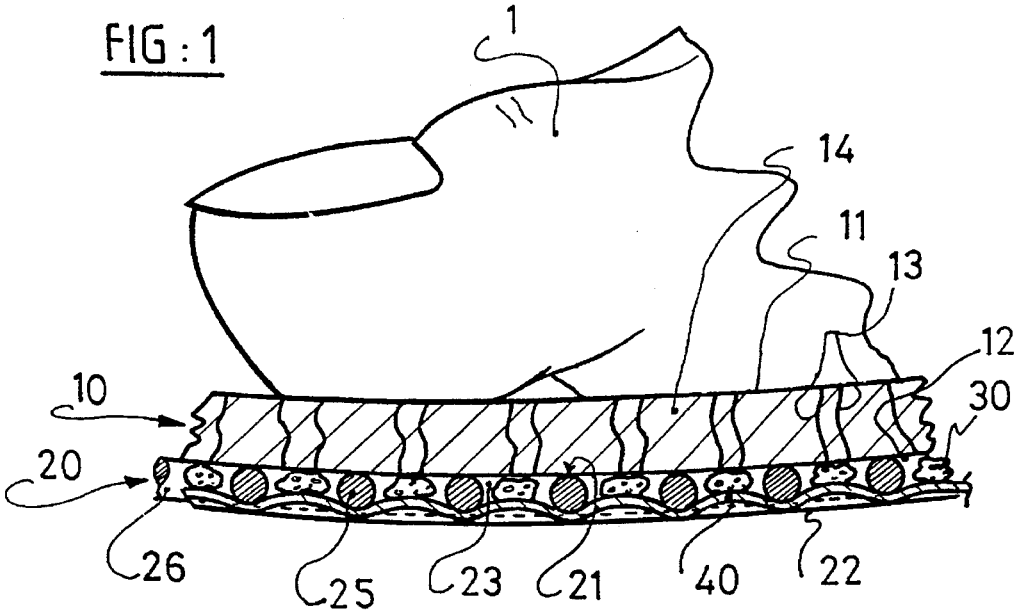
FIG. 1 is a partial longitudinal cross-section of an insole according to a first embodiment of the invention.

The insole according to the invention, as shown in FIG. 1, is formed principally by two layers, i.e., a first layer 10 positioned facing the foot 1 and designed to receive the foot on its upper surface 11, and a second layer 20, whose upper surface 21 is in contact with the lower surface 12 of the first layer 10 and whose lower surface 22 rests on the bottom of the shoe (not shown).

The first layer 10 is formed so as to promote the flow of perspiration from its upper surface 11 to its lower surface 12, and it is, in this embodiment, formed of a hydrophobic material 14 which may be a foam through which drains 13 pass radially, i.e., from top to bottom.

In this case, the drains 13 are formed by tufts or strands which extend completely through the first layer, thereby allowing the flow of moisture from the upper surface 11 to the lower surface 12 of this first layer.

The tufts 13 may be made of a hydrophobic material, thus providing for passage of water through capillary action. They may also be made of a hydrophilic material.

In the example shown in FIGS. 1 to 4, the second layer 20 has a grid or latticework shape, i.e., the shape of a layer of threads 25, 26 extending perpendicularly to each other. This layer 20 thus delimits, between the threads 25, 26, cavities 23 which extend from one surface of the layer to the other.

Of course, this second layer 20 may embody any other shape and be formed, for example, by a simple perforated layer, the essential feature being that this layer delimit cavities 23 which open at least into the upper surface 21 of this second layer.

The second layer 20 has, moreover, a relatively rigid structure, so that the cavities 23 can undergo virtually no deformation during walking under the effect of pressure exerted by the foot.

In the case of the grid represented in FIGS. 1 to 4, this stiffness is obtained by the use of a hard, non-deformable plastic material used for the threads 25, 26 constituting the grids.

The cavities 23 thus delimited make up a non-deformable storage volume, filled with an absorbent material 30 in this instance superabsorbent salts such as crosslinked polyacrylates.

The superabsorbent salts 30 are held in place inside the cavities 23 by a position-retention membrane 40 arranged on the outside of the lower surface 22 of the second layer 20, and assembled to the unit formed by the two layers 10, 20, by means of a peripheral stitch or by adhesive bonding, for example.

When this type of construction of the cleanliness insole is used, the moisture produced during exercise is directly transferred, by means of the tufts 13, to the cavities 23, where it is concentrated and absorbed by the absorbent salts 24, but is not transported to the rest of the shoe.

Because the cavities 23 have a volume which is substantially non-deformable and not subjected to variations of foot pressure during walking, there is no longer any risk that the moisture will travel upward under the effect of pressure exerted by the foot. The construction according to the invention thus results in an especially comfortable cleanliness insole which remains "dry" in use.

After use, one need only remove this cleanliness insole and need only be removed and dried to remove the moisture stored in the salts. It will be noted that the use of very absorbent salts makes it possible to avoid the spread of moisture in the rest of the shoe and thus preserves the life of the shoe.

It will also be noted that the use of superabsorbent materials on the lower surface of the first layer contributes to creating an osmotic-type transfer of moisture through the first layer.

In this type of transfer, the rate and quantity of water can be increased as a function of the degree of absorption of the absorbent materials used, as well as of the pressure differential existing between the top of the first layer 10 subjected to foot pressure and the underside of this layer, which is protected from pressure, at least in the area of the cavities 23 in the second layer 20.

It will be seen that the position-maintenance membrane 40 not only functions to hold the absorbent salts in place inside the cavities 23, but also keeps these salts in contact with the tufts 13 in the first layer.

This position-maintenance membrane 40 can also be used to provide for transfer, whether longitudinal, transverse, or in both directions, from one cavity 23 to another, so as to allow absorption of moisture even in the event of localized saturation of the absorbent salts located in one area, the moisture then being transferred by the membrane 40 to salts located in other cavities.

This,feature may be obtained quite simply by the use of a membrane existing as a knitted fabric or woven layer capable of transporting moisture.

The membrane 40 may also be used to transport moisture to the localized areas of absorbent salts.

Figure 2:
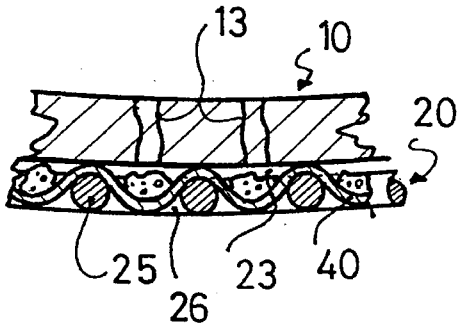
FIGS. 2 to 5 are views similar to that in FIG. 1 of insoles according to other embodiments.
Figure 3:
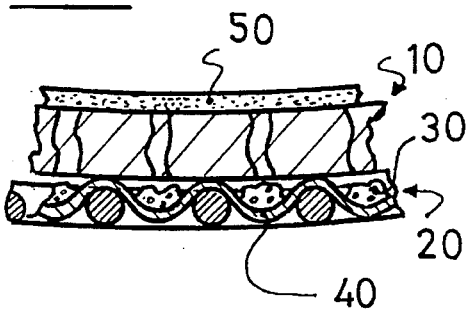
Figure 4:
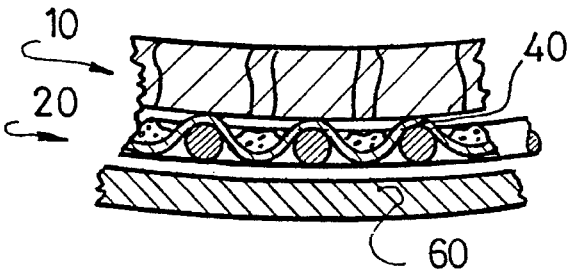

In the embodiment shown in FIG. 1, the membrane 40 is arranged on the outside of the second layer 20, but it may also be positioned between the first and second layers 10, 20, as shown in FIGS. 2, 3, and 4, in such a way that only the bottoms of the cavities 23 in this second layer are filled.

This embodiment also proves advantageous, since it permits the second layer 20 to be used to create adhesive bonding of the cleanliness insole to the bottom of the shoe. This adhesive bonding is produced, in particular, when the second layer 20 is formed by a grid, as shown in FIGS. 2 to 4.

Of course, the position of the membrane will also be chosen as a function of manufacturing criteria.

Figure 5:
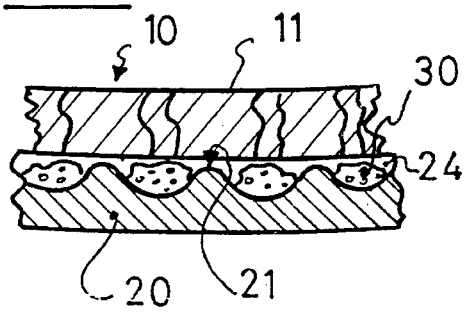

In the embodiments illustrated in FIGS. 1, 3, and 5, the first layer 10 simultaneously serves as an upper wear layer which allows water to pass through, and performs a comfort function, i.e., support and distribution of pressure, and potentially, shock absorption. This embodiment is conventionally known and can be very simply obtained, for example, by means of a layer having greater density in its upper surface.

These different functions can also be dissociated in the first layer, for example by providing a wear layer 50 (see FIG. 3) made of a hydrophobic material on the upper surface of the first layer 10, which consequently performs only comfort and moisture-transfer functions.

In the embodiment illustrated in FIG. 4, a preferably flexible layer 60 is fastened to the inside of the shoe (not shown), and thus attached independently of the cleanliness insole, first, in order not to hinder drying of the insole, and second, to facilitate better attachment and immobilization of the insole in the shoe, in which arrangement the threads 25, 26 of the grid forming the second layer 20 "catch" in the softer material of this layer, which may also constitute an additional comfort layer 60, an arrangement which proves especially advantageous in the case of a sport shoe.

Of course, this catching mechanism is possible only if the position-maintenance membrane 40 is positioned between the first and second layers, as shown in FIG. 4.

It is evident that all of the various functions could be dissociated and that an insole could also be manufactured comprising, in addition to the first and second layers, both a wear layer 50 and a comfort layer.

The cavities in the second layer 20 can also be formed by blind holes 24 which open into the upper surface 21 of this layer, as illustrated in FIG. 5, thereby obviating the use of a membrane which holds the salts in place inside these holes. To preserve its hygienic quality, the insole may be treated with an antibacterial and/or antifungal agent.

I claim:

1. Insole for shoes comprising:

(a) a first layer (10) facing a foot of a wearer and comprising drain-type means (13) allowing moisture to pass from an upper surface (11) to a lower surface (12) of said first layer; and (b) a rigid second layer (20) having an upper surface (21) in contact with said lower surface (12) of said first layer (10), said second layer delimiting cavities (23, 24) which open onto said upper surface (21) of said second layer (20) to form a substantially non-deformable moisture storage volume;

(c) an absorbent material (30) arranged within said cavities; and (d) a position-maintenance membrane (40) arranged between said first and second layers and extending on the bottom of said cavities (23) in said second layer, said absorbent material between said lower surface of said first layer and said position-maintenance membrane (40).

2. Insole according to claim 1, wherein said cavities are formed by holes (23) which open out and pass through said second layer (20) from said upper surface (21) to a lower surface (22) of said second layer.

3. Insole according to claim 2, wherein said second layer (20) has a shape of a grid.

4. Insole according to claim 1, wherein said cavities (23, 24) extend substantially perpendicularly of said second layer.

5. Insole according to claim 3, wherein said grid has a relatively rigid structure.

6. Insole according to claim 1, wherein said membrane (40) permits a transfer of moisture from one said cavity (23) to another.

7. Insole according to claim 1, wherein said first layer (10) is made of a hydrophobic material and comprises tufts (13) forming drains and extending from said upper surface (11) to said lower surface (12) of said first layer.

8. Insole according to claim 7, wherein said tufts (13) are made of hydrophobic material and provide for drainage by means of capillary action.

9. Insole according to claim 7, wherein said tufts (13) are made of a hydrophilic material.

10. Insole according to claim 1, wherein said first layer (10) is covered with a layer (50) made of a hydrophobic material which allows water to pass through.

11. Insole according to claim 1, wherein said insole is treated with an antibacterial agent.

12. Insole according to claim 1, wherein said absorbent material (30) is formed from superabsorbent salts.

* * * * *